US009873545B2

(12) United States Patent
DeVita et al.

(10) Patent No.: US 9,873,545 B2
(45) **Date of Patent: *Jan. 23, 2018**

(54) VISUAL VERIFICATION PHARMACY TRAY

(71) Applicant: CVS Pharmacy, Inc., Woonsocket, RI (US)

(72) Inventors: James T. DeVita, Middleton, MA (US); Thomas G. Davis, Cumberland, RI (US); John Rocchio, Roxbury, MA (US); Lauren Berton, Cranston, RI (US); Rory Macey, Johnston, RI (US); Vishal Amin, Providence, RI (US); Swati Patel, Cranston, RI (US)

(73) Assignee: CS Pharmacy, Inc., Woonsocket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/356,246

(22) Filed: Nov. 18, 2016

(65) Prior Publication Data

US 2017/0065487 A1 Mar. 9, 2017

Related U.S. Application Data

(63) Continuation-in-part of application No. 14/321,485, filed on Jul. 1, 2014, now Pat. No. 9,532,928.

(51) Int. Cl.

| | |
|---|---|
| ***A61J 7/02*** | (2006.01) |
| ***B65D 6/00*** | (2006.01) |
| ***A61J 7/00*** | (2006.01) |
| ***B65D 25/42*** | (2006.01) |
| ***B65D 25/54*** | (2006.01) |

(52) U.S. Cl.

CPC ..... *B65D 11/10* (2013.01); *A61J 7/0069* (2013.01); *A61J 7/02* (2013.01); *B65D 25/42* (2013.01); *B65D 25/54* (2013.01)

(58) Field of Classification Search

CPC ..... A61J 7/02; A61J 7/0069; A61J 7/0076; B65D 25/42; B65D 25/40; B65D 83/04; B65B 67/02; B65B 67/04; B65B 39/00; B65B 39/007; B07B 13/00; B07B 13/04; B07B 13/004; B07B 13/14; B07C 7/00; B07C 7/04; G07D 9/00

USPC ..... 206/528, 557; 220/571; 209/614, 682, 209/702

See application file for complete search history.

(56) References Cited

U.S. PATENT DOCUMENTS

| | | | | |
|---|---|---|---|---|
| 2,754,030 | A | 7/1956 | Waber et al. | |
| 2,812,076 | A | 11/1957 | Mistretta | |
| 3,169,643 | A | 2/1965 | Roberts | |
| 3,747,756 | A | 7/1973 | Wheeler | |
| D248,078 | S | 6/1978 | Warnekros | |
| 4,298,157 | A | 11/1981 | DeVierno | |
| D262,507 | S | 1/1982 | Wooldridge | |
| 4,502,612 | A | 3/1985 | Morrison | |
| D298,968 | S | 12/1988 | McAllister | |
| 6,092,646 | A * | 7/2000 | Glazier | A45C 11/005 206/5.1 |

(Continued)

*Primary Examiner* — Robert Poon
(74) *Attorney, Agent, or Firm* — Patent Law Works LLP

(57) ABSTRACT

The present invention provides a pill tray that allows a user to efficiently and reliably verify the contents of a filled prescription. Design features that avoid the presence of sharp edges and allow visualization of the entire surface of the pill tray help reduce and/or eliminate the risk of commingling of pills between separate prescriptions.

19 Claims, 10 Drawing Sheets

(56) References Cited

U.S. PATENT DOCUMENTS

| | | | | |
|---|---|---|---|---|
| D430,399 | S | 9/2000 | Pawuk | |
| D432,308 | S | 10/2000 | Lockhart | |
| 6,366,401 | B1 * | 4/2002 | Gonda | G02B 25/002 206/769 |
| D459,581 | S | 7/2002 | Krumes | |
| 7,726,477 | B1 * | 6/2010 | Gaither | G11B 33/0422 206/308.1 |
| D637,636 | S | 5/2011 | Liao | |
| 9,532,928 | B2 * | 1/2017 | Devita | A61J 7/02 |
| 2005/0167287 | A1 * | 8/2005 | Herzog | A47F 7/03 206/6.1 |
| 2007/0080077 | A1 * | 4/2007 | Thormahlen | A45C 11/24 206/6.1 |

* cited by examiner

VISUAL VERIFICATION PHARMACY TRAY

CROSS REFERENCE TO RELATED APPLICATIONS

The present application is a continuation in part of U.S. patent application Ser. No. 14/321,485, filed Jul. 1, 2014, and entitled "Visual Verification Pharmacy Tray," the entirety of which is incorporated by reference herein.

BACKGROUND OF THE INVENTION

1. Field of the Invention

The present invention relates generally to a pill tray for pharmacy use, and more particularly to a pill tray that allows full visual verification of the contents therein to ensure prescription consistency. Specifically, the present invention relates to a pill tray that prevents the commingling of pills and minimizes prescription fill errors during the often repetitive process of prescription verification.

2. Background

The filling of prescriptions by automated systems has been implemented in many pharmacy practice settings to improve drug distribution, control inventory, reduce labor and decrease medication errors (See, e.g., "Implementation and evaluation of an automated dispensing system," Am. J Health-Syst Pharm. 1995, 52:823-8; "Medication cart-filling time, accuracy, and cost with an automated dispensing system," Am. J Hasp. Pharm. 1994; 51:1193-6). Despite these benefits, and contrary to expectations, studies have demonstrated that the number of prescription filling errors tends to increase with the implementation of automated systems.

In 2012 all prescriptions filled with automated systems were required to undergo a process known as Full Visual Verification (FVV). This process requires a pharmacist to pour the contents of each prescription vial filled with automated systems onto a counting tray to ensure product consistency. Upon verification that a prescription contains the correct type and number of pills, the pharmacist transfers the contents of the counting tray back into the prescription vial. The high volume of prescriptions filled in a typical pharmacy each day often requires the pharmacists to perform FVV for multiple automatically filled prescriptions in sequence. The highly repetitive process of transferring large numbers of pills to and from their respective containers naturally lends itself to errors. One such error, with potentially life threatening consequences, is commingling of medications due to the inadvertent transfer of stray pill(s) from one prescription vial to another. Structural features of the counting tray itself, such as crevices in which pills become temporarily lodged and/or blind spots that limit the pharmacist's ability to identify stray pills, are a significant factor in these comingling events. In view of the unlimited variety of pill sizes, colors and shapes (e.g., round, oblong, oval, elliptical, square, cylindrical, rectangular, diamond-shaped, cone-shaped triangular, crescent-shaped, trapezoidal, pentagonal, hexagonal, heptagonal, octagonal etc.) even minor surface disruptions within a counting tray represent potential areas in which a pill may become lodged. What is needed is an improved pill tray that allows the pharmacists to verify the accuracy and consistency of prescription contents in a safe and efficient manner.

SUMMARY OF THE INVENTION

In one aspect, the present invention is directed to a visual verification pill tray apparatus comprising a first trapezoidal portion comprising a substantially planar first floor surface comprising first, second, third and fourth sides; the first and third sides of the first trapezoidal portion being substantially parallel to each other; the first side of the first trapezoidal portion characterized by a length that is shorter than the third side of the first trapezoidal portion; a second trapezoidal portion comprising a substantially planar second floor surface comprising first, second, third and fourth sides; the first and third sides of the second trapezoidal portion being substantially parallel to each other; the first side of the second trapezoidal portion characterized by a length that is shorter than the third side of the second trapezoidal portion; the third side of the second trapezoidal portion adjoining the first side of the first trapezoidal portion; the substantially planar second floor surface forming an obtuse angle with respect to the substantially planar first floor surface; an open-ended spout extending from the second trapezoidal portion, the spout comprising a third floor surface adjoining the first side of the second trapezoidal portion; a common sidewall extending upwards from the first floor surface, the second floor surface and the third floor surface; wherein the first trapezoidal portion, the second trapezoidal portion, the spout and the sidewall together define a base portion; and a substantially transparent surface covering the second floor surface, the substantially transparent surface being immoveable with respect to the base portion.

In another aspect, the present invention is directed to a method of verifying the consistency of a prescription using the visual verification pill tray apparatus of the present invention.

BRIEF DESCRIPTION OF THE DRAWINGS

Non-limiting embodiments of the present invention will be described by way of reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

Various objects, features, aspects, and advantages of the present invention will become more apparent from the following detailed description of preferred embodiments of the invention, along with the accompanying drawings in which like numerals represent like components.

DETAILED DESCRIPTION

While various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a," "an" and "the" are not intended to refer to only a singular entity, but include the general class of which a specific example may be used for illustration. The terminology herein is used to describe specific embodiments of the invention, but their usage does not delimit the invention, except as outlined in the claims.

The phrase "and/or," as used herein should be understood to mean "either or both" of the elements being referred to, i.e., elements that are conjunctively present in some instances and disjunctively present in other instances. Other elements may optionally be present other than the elements specifically identified by the "and/or" clause, whether related or unrelated to those elements specifically identified unless clearly indicated to the contrary. Thus, as a non-limiting example, a reference to "A and/or B", when used in conjunction with open-ended language such as "comprising" can refer, in one embodiment, to B without A (optionally including elements other than A); in yet another embodiment, to both A and B (optionally including other elements); etc.

It will be understood that the term "preferably" as used throughout the specification refers to one or more exemplary embodiments of the invention and therefore is not to be interpreted in any limiting sense. It will be further understood that terms of orientation and/or position as may be used throughout the specification, such as upper, lower, rear, side, forward, downward, upward, inner and so on, as well as their derivatives and equivalent terms, relate to relative rather than absolute orientations and/or positions.

Figure 1:
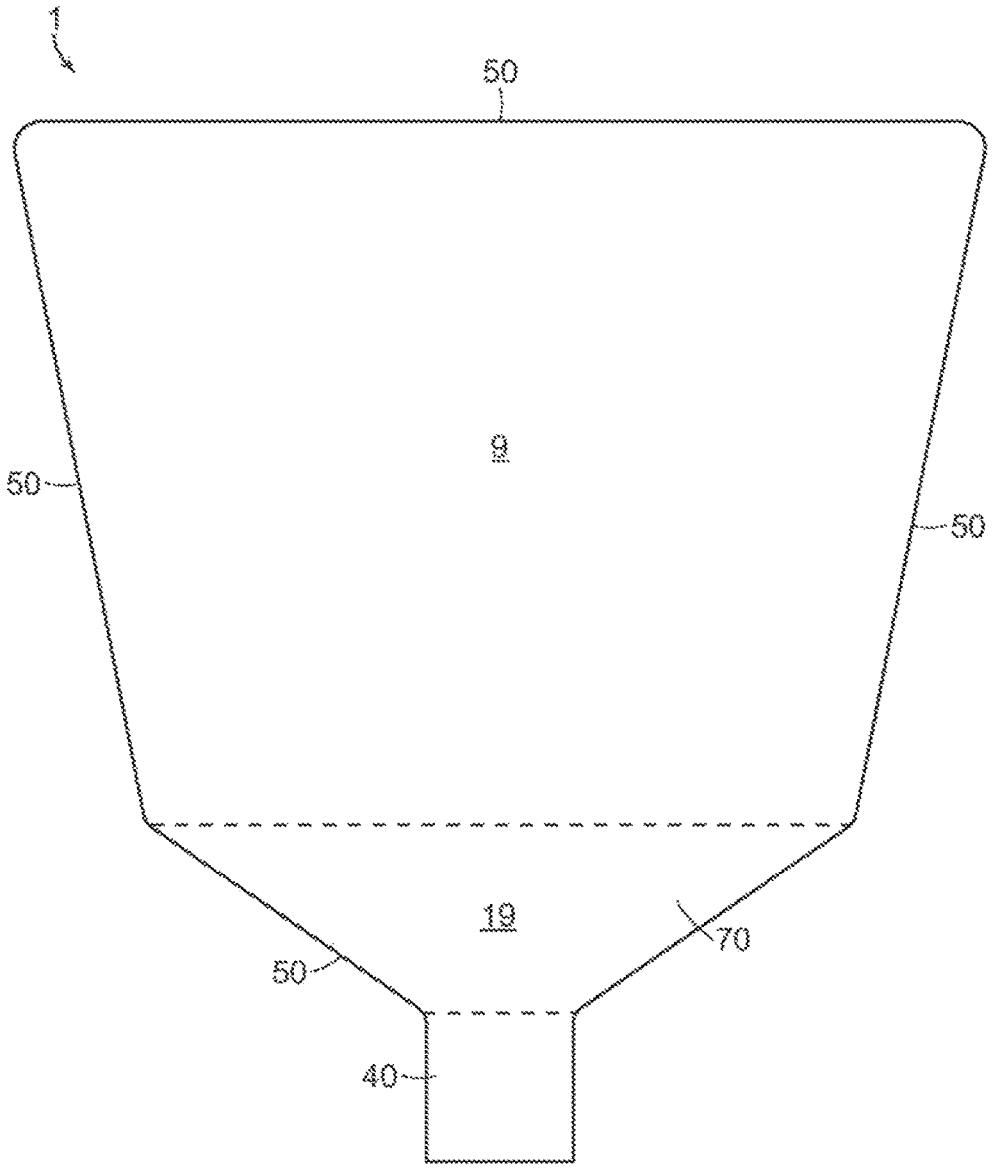
FIG. 1 depicts a top view of a pill tray, in accordance with an embodiment of the present invention.
Figure 2:
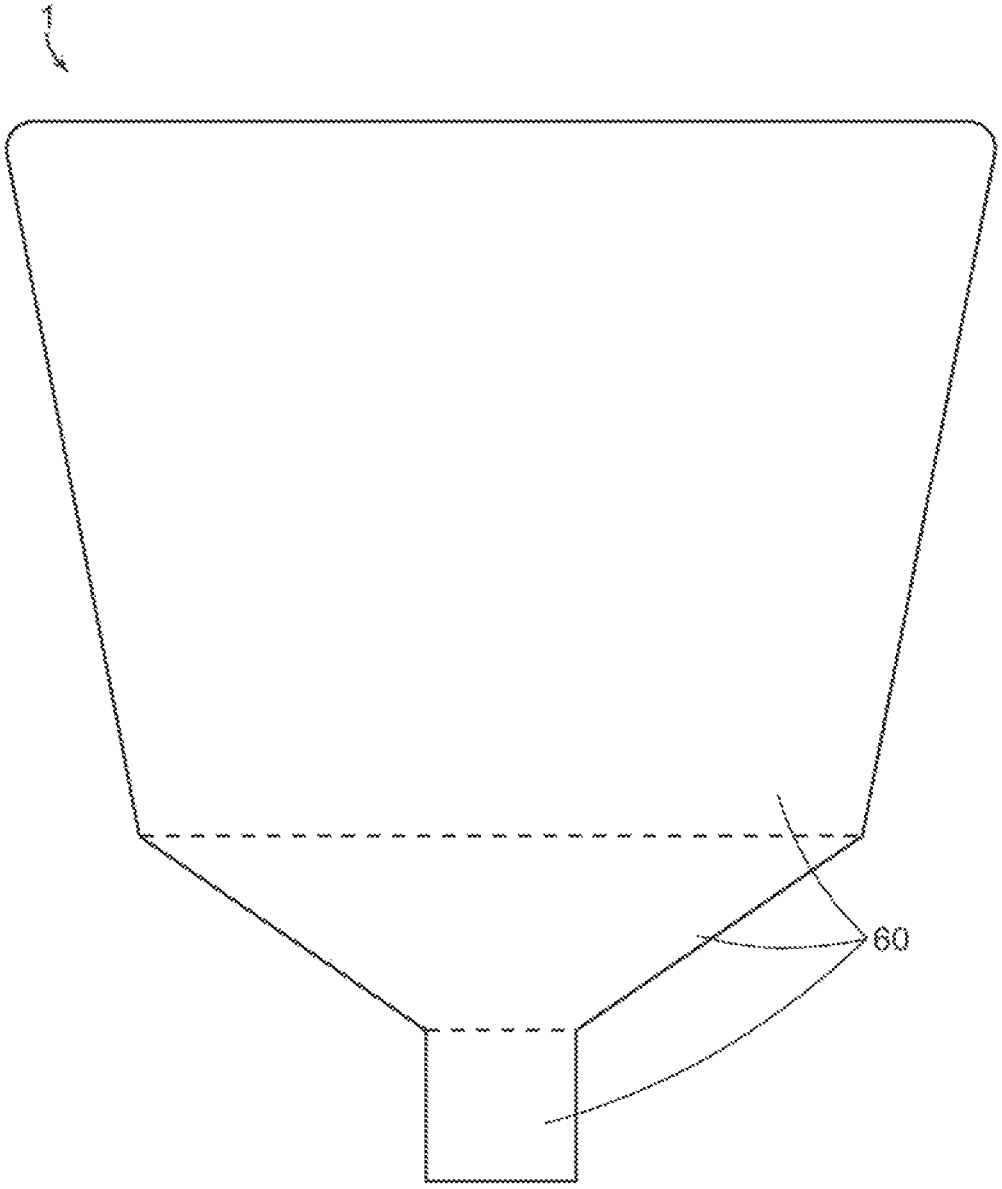
FIG. 2 depicts a top view of a pill tray, in accordance with an embodiment of the present invention.

Referring to the drawings, and to FIG. 1 in particular, a visual verification pill tray apparatus 1 in accordance with an exemplary embodiment of the present invention is illustrated. The apparatus 1 may be interchangeably referred to herein as a "pill tray" or a "pharmacy tray." As referred to herein, a "pill" is any suitable pharmaceutical dosage form. The visual verification pill tray apparatus preferably comprises a first trapezoidal portion 9, second trapezoidal portion 19, open-ended spout 40, common sidewall 50 and substantially transparent surface 70. Together the first trapezoidal portion 9, second trapezoidal portion 19, spout 40 and sidewall 50 define base portion 60 (FIG. 2).

Figure 3:
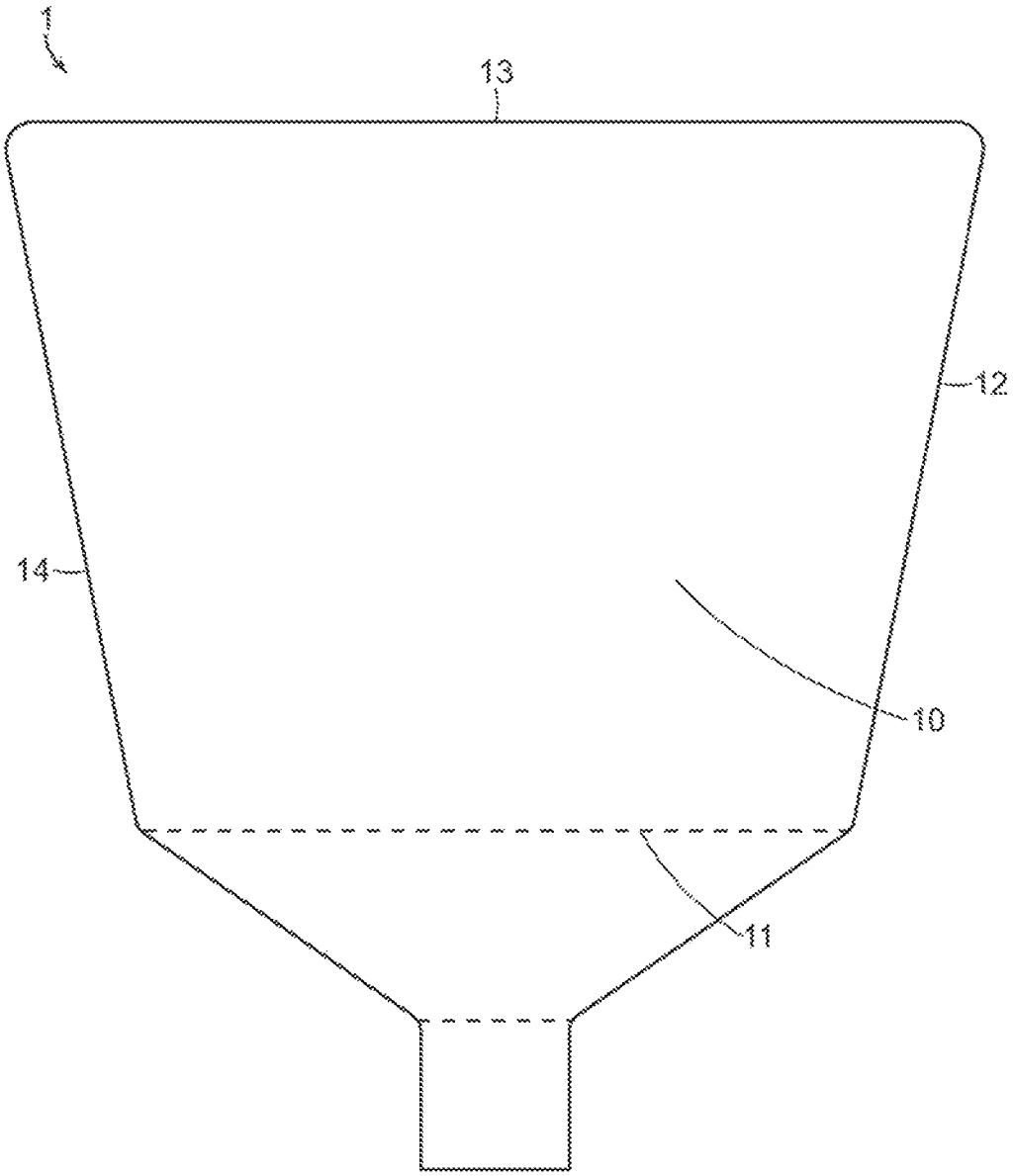
FIG. 3 depicts a top view of a pill tray, in accordance with an embodiment of the present invention.
Figure 4:
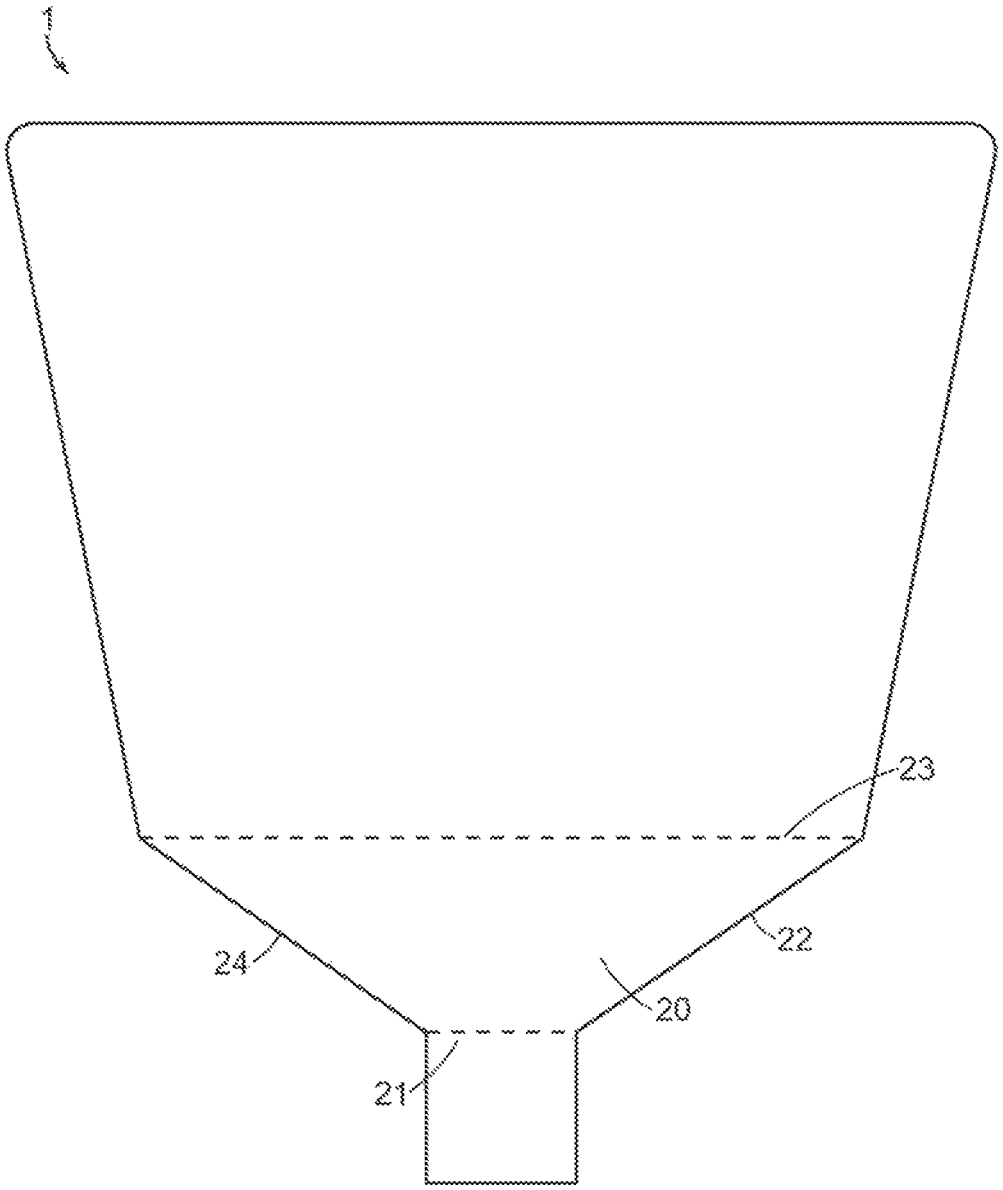
FIG. 4 depicts a top view of a pill tray, in accordance with an embodiment of the present invention.
Figure 5:
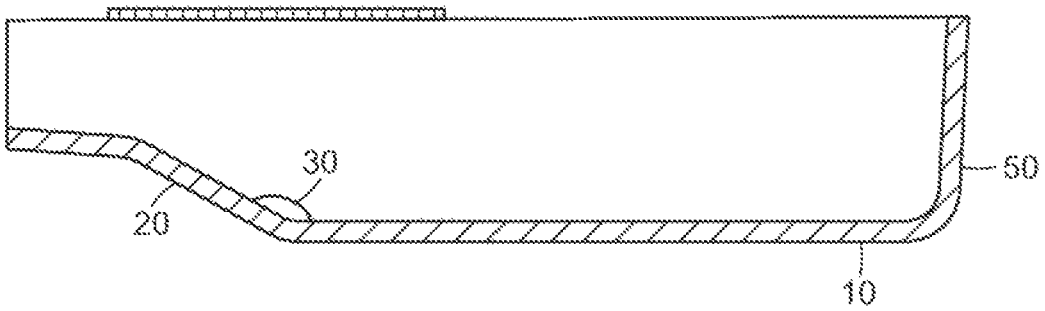
FIG. 5 is a cross-sectional view of a pill tray, in accordance with an embodiment of the present invention.

As illustrated in FIGS. 3 and 4, first trapezoidal portion 9 comprises a substantially planar first floor surface 10 having first 11, second 12, third 13 and fourth 14 sides. First side 11 and third side 13 are substantially parallel to each other, with first side 11 having a length that is less (i.e., shorter) than that of third side 13. The second trapezoidal portion 19 comprises a substantially planar second floor surface 20 having first 21, second 22, third 23 and fourth 24 sides. First side 21 and third side 23 are substantially parallel to each other, with first side 21 having a length that is less (i.e., shorter) than that of third side 23. Third side 23 of second trapezoidal portion 19 adjoins first side 11 of second trapezoidal portion 9. As shown in FIG. 5, second floor surface 20 form an obtuse angle 30 with respect to first floor surface 10. Common sidewall 50 extends upward from first floor surface 10, second floor surface 20 and third floor surface 43 (below), as shown in FIGS. 5 and 6.

Without intending to limit the present invention to any specific dimensions, in one embodiment, the height of sidewall 50 as measured from first floor surface 10 is preferably at least 1.5 inches and more preferably at least 2.0 inches. The height of sidewall 50 as measured from third floor surface 43 is preferably within the range of 1.0 to 1.5 inches. The thickness of sidewall 50, first floor surface 10 and second floor surface 20 are all preferably within the within the range of 0.10 to 0.30 inches. The third side 13 of first trapezoidal surface portion 9 preferably has a length of at least 7.0 inches, more preferably at least 8.0 inches. The overall length of the visual verification pill tray apparatus (i.e., from third side 13 to spout 40) is at least 7.0 inches.

Figure 6:
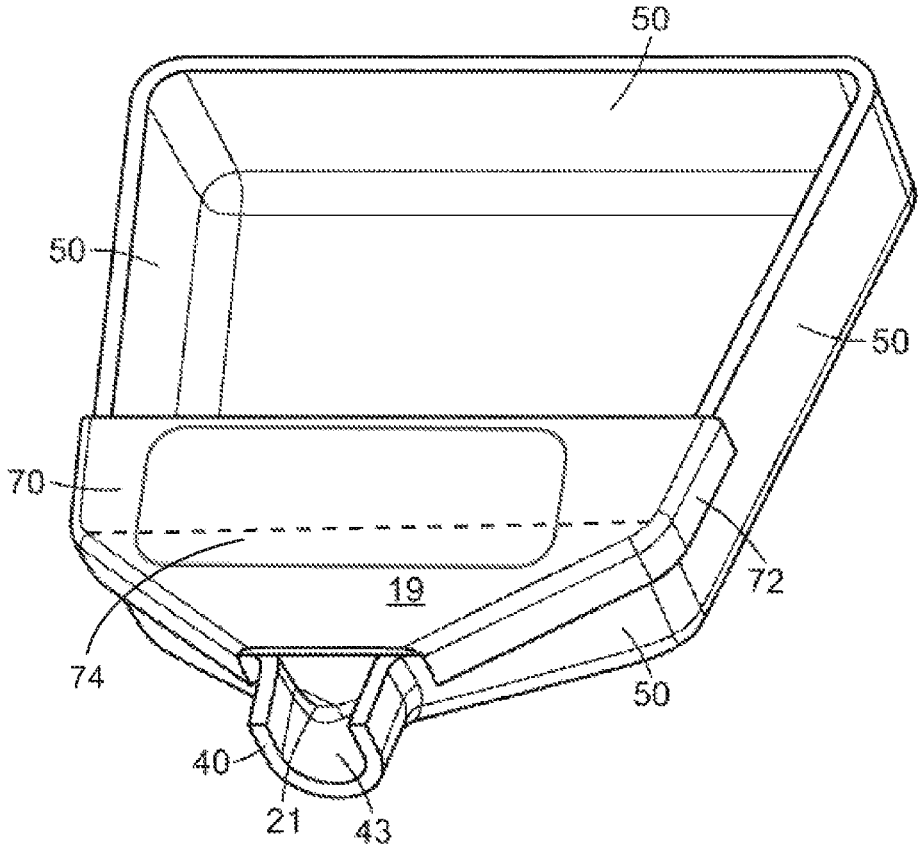
FIG. 6 is a front elevational view of a pill tray, in accordance with an embodiment of the present invention.
Figure 7:
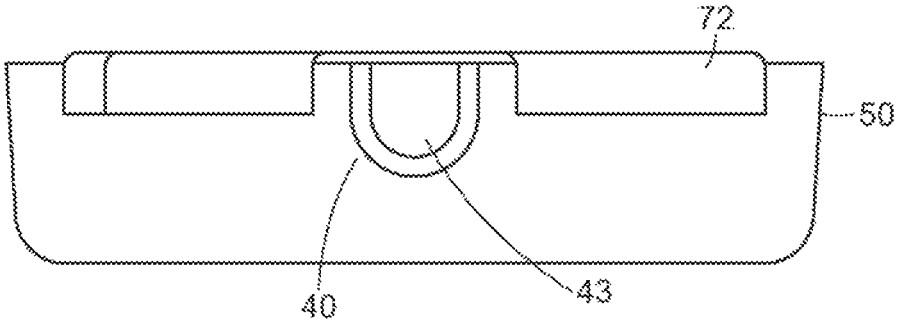
FIG. 7 is a front view of a pill tray, in accordance with an embodiment of the present invention.

As illustrated in FIGS. 6 and 7, open-ended spout 40 extends from second trapezoidal portion 19, and includes a third floor surface 43 that adjoins first side 21 of the second trapezoidal portion 19. As used herein, the term "spout" refers to any nozzle, funnel other opening through which the liquid or solids contents of a container may be passed or poured. Spout 40 is preferably shaped to fit within the opening of standard prescription vials such that the contents of apparatus 1 may be poured directly into a container such as a prescription vial. Without intending to limit the present invention to any specific dimensions, in one embodiment, open-ended spout 40 has a height of at least 1.0 inches.

Figure 8:
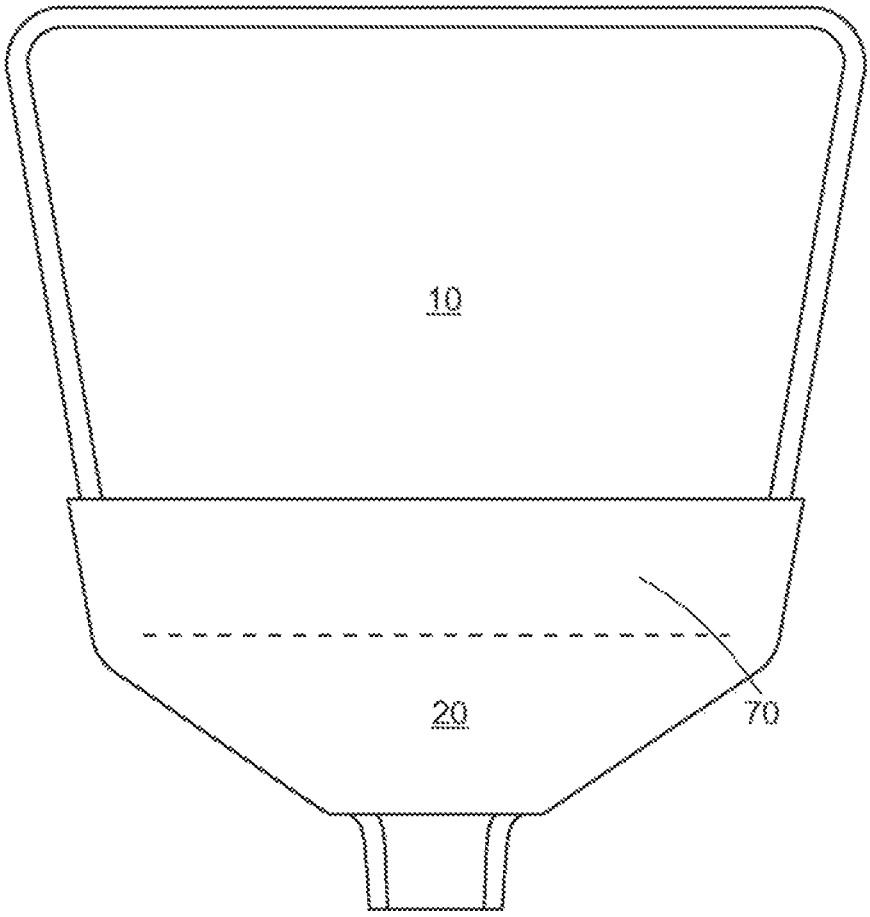
FIG. 8 is a top view of a pill tray, in accordance with an embodiment of the present invention.
Figure 9:
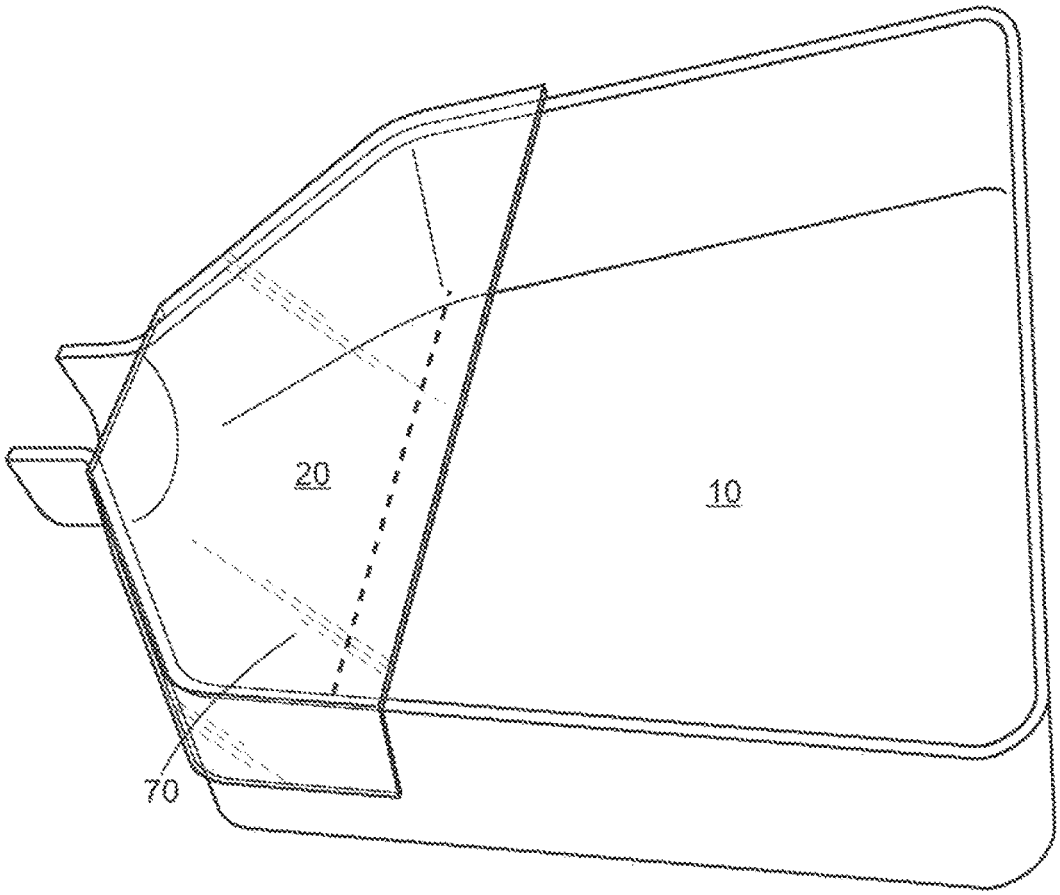
FIG. 9 is a side-elevational view of a pill tray, in accordance with an embodiment of the present invention.
Figure 10:
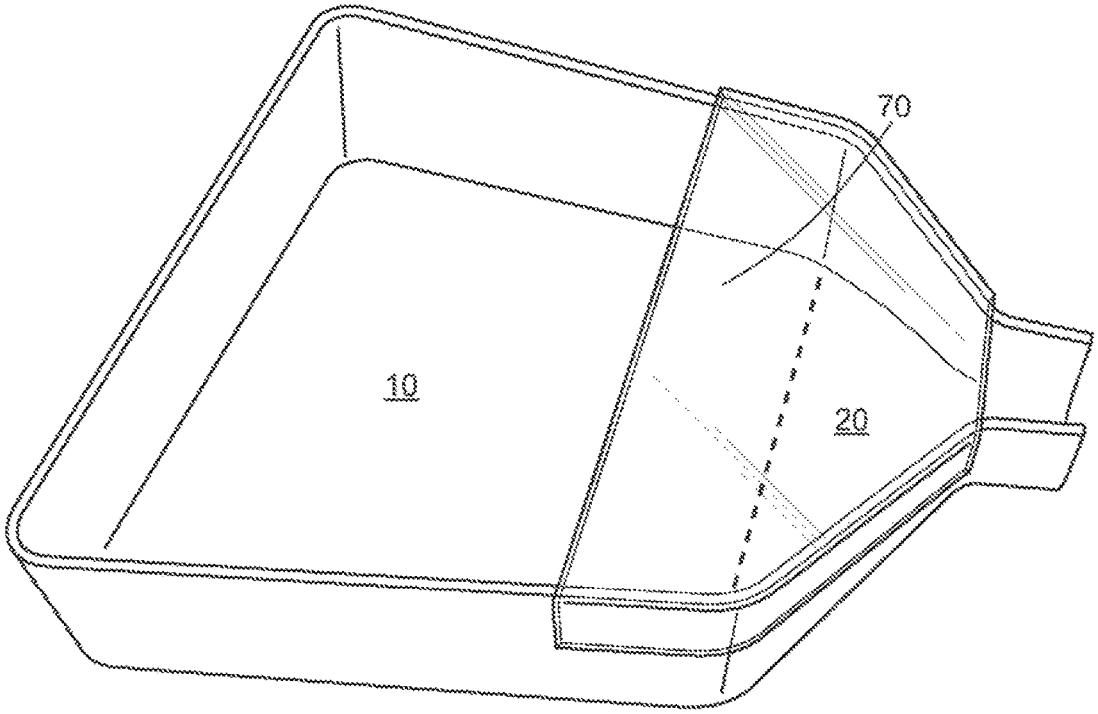
FIG. 10 is a side-elevational view of a pill tray, in accordance with an embodiment of the present invention.

As illustrated in FIGS. 8-10, substantially transparent surface 70 covers second floor surface 20 and is immovable with respect to base portion 60. In another embodiment, substantially transparent surface 70 covers second floor surface 20 and a portion of first floor surface 10. In yet another embodiment, substantially transparent surface 70 covers a portion of third floor surface 43 (not shown). In another embodiment, substantially transparent surface 70 covers second floor surface 20 and first floor surface 10. In some embodiments, substantially transparent surface 70 that covers second floor surface 20 and first floor surface 10 includes a hinge means known in the art, but not limited to, continuous hinges, butt hinges, flag hinges, latch hinges, living hinges, spring hinges, pin and barrel hinges and stop hinges. Hinge means allows a portion of the transparent surface to lift away from base portion 60 to allow access to contents of base portion 60. In one embodiment, substantially transparent surface 70 includes a magnification portion 74. In one embodiment, the magnification portion 74 covers the entirety of substantially transparent surface 70. In another embodiment, magnification portion covers only a portion of substantially transparent surface 70.

As illustrated in FIGS. 6 and 7, in one embodiment the substantially transparent surface 70 comprises a downwardly extending lip 72 that engages side wall 50. Substantially transparent surface 70 is preferably fixed to side wall 50 by a variety of attaching means known in the art including, but not limited to adhesives, glues, cements, welding, thermal bonding, injection molding and soldering. Alternatively, substantially transparent surface 70 is removably attached (i.e., for cleaning) to side walls 50 by a variety of attaching means such as clips, clamps, bolts and the like. Regardless of whether the substantially transparent surface 70 is fixed or removably attached to the base portion 60, it is said to be immoveable with respect thereto because, when in use, the portion of the substantially transparent surface 70 is fixed relative to the base portion 60. The location of substantially transparent cover 70 relative to second floor surface 20 allows a user to visualize the entire base portion 60 such that any pills lodged within pill counting apparatus 1 may be identified. Without intending to limit the present invention to any specific dimensions, in one embodiment, substantially transparent surface 70 is preferably characterized by a thickness within the range of 0.05 to 0.15 inches, a length of within the range of 6.5 to 7.5 inches and a width within the range of 2.5 to 3.5 inches.

Firm plastics and flexible adhesives known in the art may be used to provide an apparatus capable of withstanding repetitive use as well as high impact forces, such as when inadvertently dropped to the floor. In one embodiment, first trapezoidal portion 9, second trapezoidal portion 19 and spout 40 are comprised of one or more polymers such as high density polyethylene (HDPE), low density polyethylene (LDPE) and polypropylene (PP). Similarly, transparent cover 70 is comprised of polymers such as high density polyethylene (HDPE), low density polyethylene (LDPE) and polypropylene (PP). Due to the wide variety pill colors and compositions (i.e., hard shelled capsule, soft shell capsules, gelatin capsules, capsules enclosing liquids, capsules enclosing powders etc.) the polymers used to form the first trapezoidal portion 9, second trapezoidal portion 19 and spout 40 preferably include a color that provides a high contrast (for example, light blue) with such pills while limiting the build-up of chalky binding agents.

It will be understood that polymers such as the ones listed above are amenable to a variety of forming methods including, for example, vacuum forming and injection molding. These forming methods provide smoothly contoured transitions between the components of a pill tray, thereby avoiding edges, crevices, ledges, burrs etc. within which pills may become temporarily lodged. As best illustrated by FIG. 6 (shadowed lines), sidewall 50 extends upward from first floor surface 10 and second floor surface 20 with a smooth (e.g., rounded, tapered, gradual) contour that prevents pills from getting temporarily stuck. Spout 40 extends from second trapezoidal portion 19 with a similar smooth contour.

Visual verification pill tray apparatus 1 may comprise a variety of sizes and shapes, and is in no way limited to the dimensions provided in the present figures. In a preferred embodiment, visual verification pill tray apparatus 1 with the approximate dimensions of 8"×6"×2" (length×width×height) is able to hold the contents of a standard 60 dram prescription flat across first floor surface 10. The greater length of third side 13 of first floor 10 relative to first side 11 maximizes the area in which pills may be poured and verified. The dimensions of visual verification pill tray apparatus 1 defined by first trapezoidal portion 9 and second trapezoidal portion 19 permits the user to tip pill counting apparatus 1 such that the pills slide and/or roll towards spout 40. The height of sidewall 50 permits the entire contents of a prescription to be poured back into the original prescription vial without any spillage. Substantially transparent cover 70 allows the user to visually verify that no stray pills remain lodged within the visual verification pill tray apparatus. In the unlikely event that a stray pill is identified, the user may gently tap spout 40 against the outer rim of the prescription vial to dislodge the pill.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An apparatus comprising:

a first trapezoidal portion comprising a substantially planar first floor surface comprising first, second, third and fourth sides, the first and third sides of the first trapezoidal portion being substantially parallel to each other, the first side of the first trapezoidal portion characterized by a length that is shorter than the third side of the first trapezoidal portion;

a second trapezoidal portion comprising a substantially planar second floor surface comprising first, second, third and fourth sides, the first and third sides of the second trapezoidal portion being substantially parallel to each other, the first side of the second trapezoidal portion characterized by a length that is shorter than the third side of the second trapezoidal portion, the third side of the second trapezoidal portion adjoining the first side of the first trapezoidal portion, an entirety of the substantially planar second floor surface forming an obtuse angle with respect to an entirety of the substantially planar first floor surface;

an open-ended spout extending from the second trapezoidal portion, the spout comprising a third floor surface adjoining the first side of the second trapezoidal portion;

a common sidewall extending upwards from the first floor surface, the second floor surface and the third floor surface;

wherein the first trapezoidal portion, the second trapezoidal portion, the spout and the sidewall together define a base portion; and a substantially transparent surface covering the second floor surface, the substantially transparent surface being immoveable with respect to the base portion and including a magnification portion.

2. The apparatus of claim 1, wherein the substantially transparent surface covers a portion of the first floor surface.

3. The apparatus of claim 1, wherein the substantially transparent surface covers the first floor surface.

4. The apparatus of claim 3, wherein the substantially transparent surface comprises a hinge.

5. The apparatus of claim 1, wherein the substantially transparent surface covers a portion of the third floor surface.

6. The apparatus of claim 1, wherein the substantially transparent surface is fixed to the sidewall.

7. The apparatus of claim 6, wherein the substantially transparent surface comprises a downwardly extending lip that engages the sidewall.

8. The apparatus of claim 1, wherein the first trapezoidal portion, the second trapezoidal portion and the spout comprise a polymer selected from the group consisting of high density polyethylene (HDPE), low density polyethylene (LDPE) and polypropylene (PP).

9. The apparatus of claim 1, wherein the substantially transparent surface comprises a polymer selected from the group consisting of high density polyethylene (HDPE), low density polyethylene (LDPE) and polypropylene (PP).

10. The apparatus of claim 1, wherein the sidewall is characterized by a height of at least 1.5 inches as measured from the first floor surface.

11. The apparatus of claim 10, wherein the sidewall is characterized by a height less than 1.5 inches as measured from the third floor surface.

12. The apparatus of claim 1, wherein the sidewall is characterized a thickness within the range of 0.10 to 0.30 inches.

13. The apparatus of claim 1, wherein each of the first and second floor surfaces are characterized by a thickness within the range of 0.10 to 0.30 inches.

14. The apparatus of claim 1, wherein the third side of the first trapezoidal portion is characterized by a length of at least 7.0 inches.

15. The apparatus of claim 14, wherein the apparatus is characterized by an overall length of at least 7.0 inches.

16. The apparatus of claim 1, wherein the substantially transparent surface is characterized by a thickness within the range of 0.05 to 0.15 inches.

17. The apparatus of claim 16, wherein the substantially transparent surface is characterized by a length within the range of 6.5 to 7.5 inches.

18. The apparatus of claim 17, wherein the substantially transparent surface is characterized by a width within the range of 2.5 to 3.5 inches.

19. The apparatus of claim 1, wherein the open-ended spout is characterized by a height of at least 1.0 inches.

* * * * *